US007555877B2

(12) United States Patent
Redaelli

(10) Patent No.: US 7,555,877 B2
(45) Date of Patent: Jul. 7, 2009

(54) ROTATING-HEAD MACHINE FOR PACKAGING PRODUCTS IN SEALED FILM

(75) Inventor: Marco Redaelli, Cassina de' Pecchi (IT)

(73) Assignee: Eurosicma S.p.A., Milan MI (IT)

( * ) Notice: Subject to any disclaimer, the term of this patent is extended or adjusted under 35 U.S.C. 154(b) by 113 days.

(21) Appl. No.: 11/918,444

(22) PCT Filed: Apr. 13, 2006

(86) PCT No.: PCT/EP2006/003779

§ 371 (c)(1),
(2), (4) Date: Oct. 15, 2007

(87) PCT Pub. No.: WO2006/108710

PCT Pub. Date: Oct. 19, 2006

(65) Prior Publication Data

US 2009/0038264 A1 Feb. 12, 2009

(30) Foreign Application Priority Data

Apr. 15, 2005 (IT) ..... MI2005A000664

(51) Int. Cl.
*B65B 11/28* (2006.01)
*B65B 11/48* (2006.01)

(52) U.S. Cl. ..... 53/234; 53/374.5

(58) Field of Classification Search ..... 53/228–234, 53/374.5; *B65B 11/28, 11/30, 11/32, 11/36, B65B 11/48*

See application file for complete search history.

(56) References Cited

U.S. PATENT DOCUMENTS

| | | | | | |
|---|---|---|---|---|---|
| 3,899,865 | A * | 8/1975 | Revaz | ..... | 53/234 |
| 4,495,745 | A | 1/1985 | Crescenzo et al. | | |
| 5,269,117 | A * | 12/1993 | Boriani et al. | ..... | 53/234 |
| 5,699,893 | A * | 12/1997 | Spada | ..... | 53/234 |
| 2003/0230053 | A1 * | 12/2003 | Salicini et al. | ..... | 53/234 |

FOREIGN PATENT DOCUMENTS

| | | |
|---|---|---|
| EP | 0 854 084 | 7/1998 |
| EP | 1 059 236 | 12/2000 |

OTHER PUBLICATIONS

International Search Report dated Dec. 5, 2006.

* cited by examiner

*Primary Examiner*—Stephen F Gerrity
(74) *Attorney, Agent, or Firm*—Jacobson Holman PLLC

(57) ABSTRACT

A machine for packaging products (13) in sealed film (25), comprises a product inlet feeding bench (12), a rotating head (15) for receiving and conveying products arriving sequentially from the feeding bench to a loading station (14) in the head and an outlet bench (17) that receives the products conveyed by the rotating head (15) to an unloading station (16) to evacuate them from the machine. The rotating head (15) comprises peripherally seats (30, 31) for receiving products and a sealing device (45, 46, 47, 48) that rotates with these seats (30, 31) to achieve sealing of a film wound around the product in a seat (30, 31) whilst the head rotates to take the seat (30, 31) from the loading station (14) to the unloading station (31).

16 Claims, 10 Drawing Sheets

ROTATING-HEAD MACHINE FOR PACKAGING PRODUCTS IN SEALED FILM

This is a national state of PCT/EP2006/003779 filed Apr. 13, 2006 and published in English.

The present invention relates to a machine for packaging products through winding and sealing of a plastic film.

In the prior art, packaging machines are known that are equipped with a conveyor that sequentially feeds the products to be packaged to a rotating head. The rotating head receives the products and conveys them rotationally through fixed stations arranged around the head. At the fixed stations the various folding and sealing devices are present that conduct the various operations of partial packaging before the product reaches a release station.

As in traditional machines, the various devices are located in fixed stations on the structure, the head is obliged to await at them to conduct the sealing operations with consequently a relatively high number of product pick-up stations (normally six or eight) arranged on the head. The complexity of the machine is therefore rather great and the machine becomes fragile and very difficult to commission.

Furthermore, in traditional machines, the duration of all mechanically generated movement is generally proportional to actual operating speed. Thus high temperature of the sealing blades set for a short sealing time at top speed is too high at low speeds with longer sealing time, with consequent burning of the sealing.

The general object of the present invention is to overcome the aforementioned drawbacks by providing an innovative packaging machine with rotating-head, in which the head supports the elements that achieve partial packaging of the product during rotation of the head. In this way it is possible to reduce the stations to two.

In view of this object it has been decided to devise, according to the invention, a machine for packaging products in sealed film, comprising a product inlet feeding bench, a rotating head for receiving and conveying products arriving sequentially from the feeding bench to a loading station in the head and an outlet bench that receives the products conveyed by the rotating head to an unloading station to evacuate them from the machine characterised in that the rotating head comprises peripherally seats for receiving products and sealing means that rotates with these seats to achieve sealing of a film wound around the product in a seat whilst the head rotates to take the seat from the loading station to the unloading station.

Advantageously, still according to the principles of the invention, it was decided to devise a machine as mentioned above in which the head comprises for each seat commanded grasping and retaining means of a product inserted into the seat and commanded pushing means of the product outside the seat, rotation of the head around the axis thereof, the grasping means, the thrusting means and the sealing means being moved synchronously with respect to one another to carry out sequentially, during rotation of the head from the loading station to the unloading station, the operations of grasping of a product inserted into a seat in the loading station, the sealing of edges of film that wrap the product, lowering sealed edges against the product, ejecting the product to the unloading station.

To make the explanation of the innovative principles of the present invention and the advantages thereof with respect to the prior art clearer, with the help of accompanying drawings a possible embodiment applying these principles will be disclosed below by way of example. In the drawings.

FIGS. 7 to 15 schematically show a sequence of operating phases of the head according to the invention.

Figure 1:
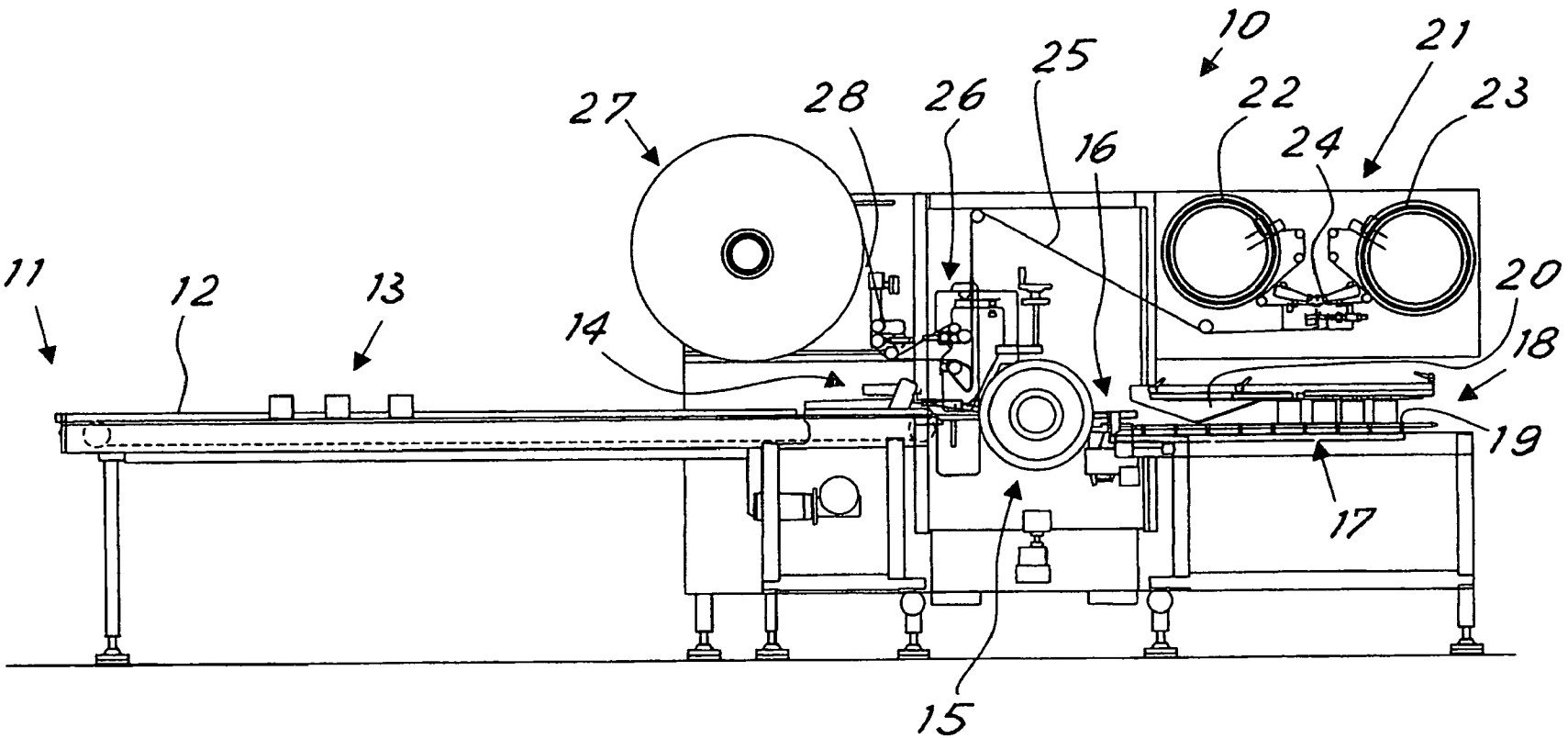
FIG. 1 is a raised side schematic view of a packaging machine according to the invention.

With reference to the figures, FIG. 1 shows a packaging machine, generally indicated by 10, made according to the principles of the present invention. The machine 10 has an inlet 11 with a feeding bench 12, on which the products 13 are loaded manually or automatically, individually or in a group, in the quantity envisaged for packaging. The feeding bench, advantageously in the form of a known slat conveying system, receives and conveys sequentially the products to be packaged to a product loading station 14 in a packaging head 15. The loading station can comprise a known pushing unit located at the end of the feeding bench for picking up the products and pushing them into the packaging head.

The products that are at least partially packaged by the head 15 are removed from the head at an opposite unloading station 16 to be sent along an outlet bench 17 to an outlet 18. As will be clear below, the outlet bench 17 may advantageously comprise known means or stations for completing the packages, which means or stations carry out folding and sealing of the side edges of the packages in transit. Advantageously, a sort of comb 19 is provided with apparent straight intermittent movement that determines step movement of the packets characterised by a shift step and a wait step. During the shift the edges are folded (by means of suitable folding planes 20) whereas during the wait step they are sealed (by means of known sealing blades that are not shown).

The machine also comprises a known reel support unit 21 for packaging material, advantageously made to contain two reels of film 22, 23, one being unwound and one being prepared. Such a unit can be made, according to the prior art, of two reel—support wheels and of two dandy-roll systems that by acting on braking of the wheels control tightening of the film. It can also be advantageously provided with a known automatic reel splice system 24 for splicing the tail of the reel being unwound but which has now finished and the head of the new reel that has been suitable prepared.

From the reel—support unit 21 the film 25 is fed to the loading zone of the head 15 by means of a known film-dragging and cutting unit 26. This unit 26 has the function of unwinding and cutting the quantity of film specified for the specific packaging. As will be easily understandable to those skilled in the art, these operations are conducted in perfect synchronism with the other packaging steps. In fact, as will be seen, cutting must be carried out exactly at the moment in which the product pushed by the pusher meets the film and traps it with a counterthrust unit during the step of inserting into the head. During the moment of cutting, the dragging system will have provided the exact length of film so that advantageously continuous unwinding at a virtually constant speed will be achieved.

Advantageously, unwinding of the film is obtained by means of rubberised rollers controlled by a reduction gear and cutting is by means of a rotating knife, which knife is also controlled by a suitable reduction gear. Variation of the cutting step is obtainable by modifying parameters set on the machine.

In addition, a further known reel support 27 can be provided for feeding a backing sheet 28, for example cardboard, which is inserted into the package, suitably cut and shaped, according to the prior art. This is useful for example in the case of packaging of products consisting of several grouped elements such as packets of biscuits, for example.

Figure 2:
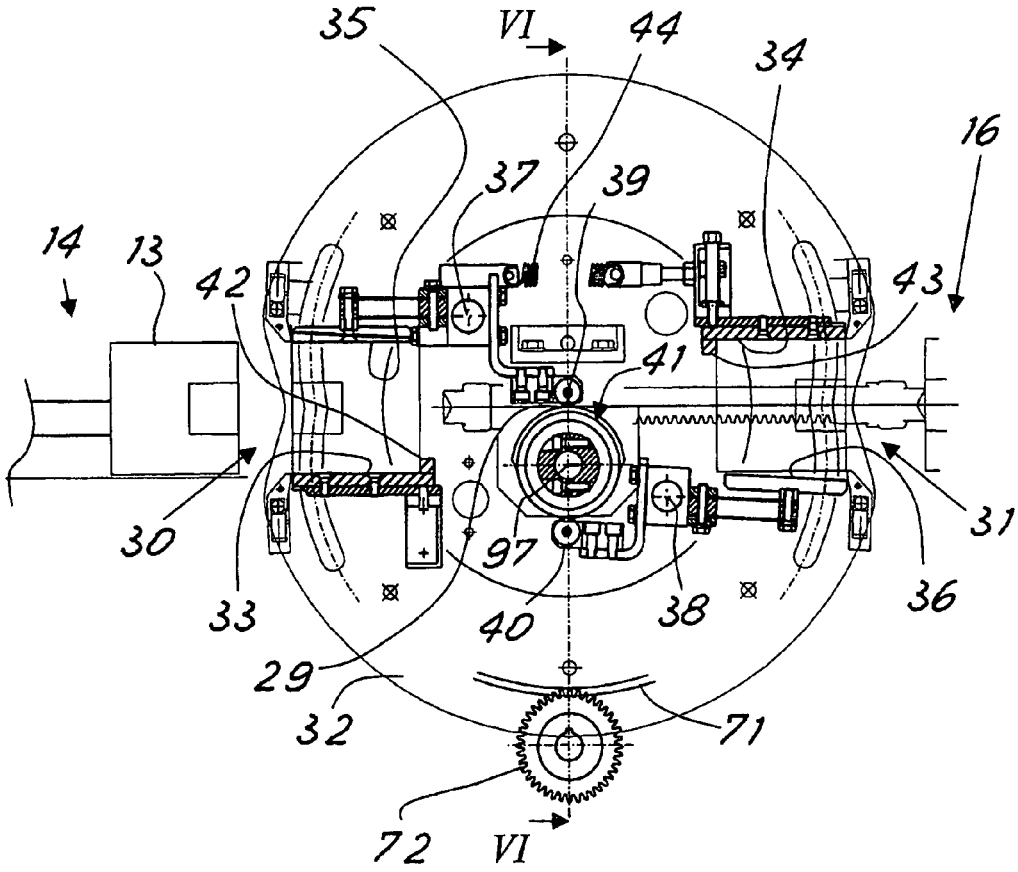
FIG. 2 is a first schematic side view of a part of a mechanism arranged on the rotating head of the machine in FIG. 1 for picking up the products.

In FIG. 2 the packaging head 15 is shown schematically with a part of the mechanisms thereupon being highlighted. The head has two stations or seats 30, 31 for receiving products and which are diametrically opposite so that when one is at the loading station 14, the other is at the unloading station 16.

The head 15 has a frame 32 and rotates around the central axis thereof 29 by means of coupling of a crown gear 71 (only a segment of which is shown) thereof with a driven pinion 72.

The rotating frame 32 of the head supports the various mechanisms that also rotate around the central axis.

In FIG. 2 receiving or retaining means or members of the products in the head are shown in particular. Each rotating station 30, 31 comprises a fixed tray or jaw 33, 34 and a corresponding movable jaw 35, 36. Each fixed jaw has, advantageously, a stop tooth 42, 43 for stopping the product's stroke towards the inside of the head. These jaws can be advantageously replaced as product dimensions vary.

The fixed and movable jaws are placed opposite to be arranged above and below the product to be packaged and which is inserted by the station 14 and the jaws are advantageously fitted on flat springs to adapt to the small dimensional variations of the products. The movable jaws are pivoted in 37, 38 and each has a cam follower 39, 40 for opening/closing movement controlled by means of a cam mechanism 41 rotating around an axis 97. For the movable jaw 35 the spring return 44 is shown that keeps the follower adhering to the cam.

Figure 3:
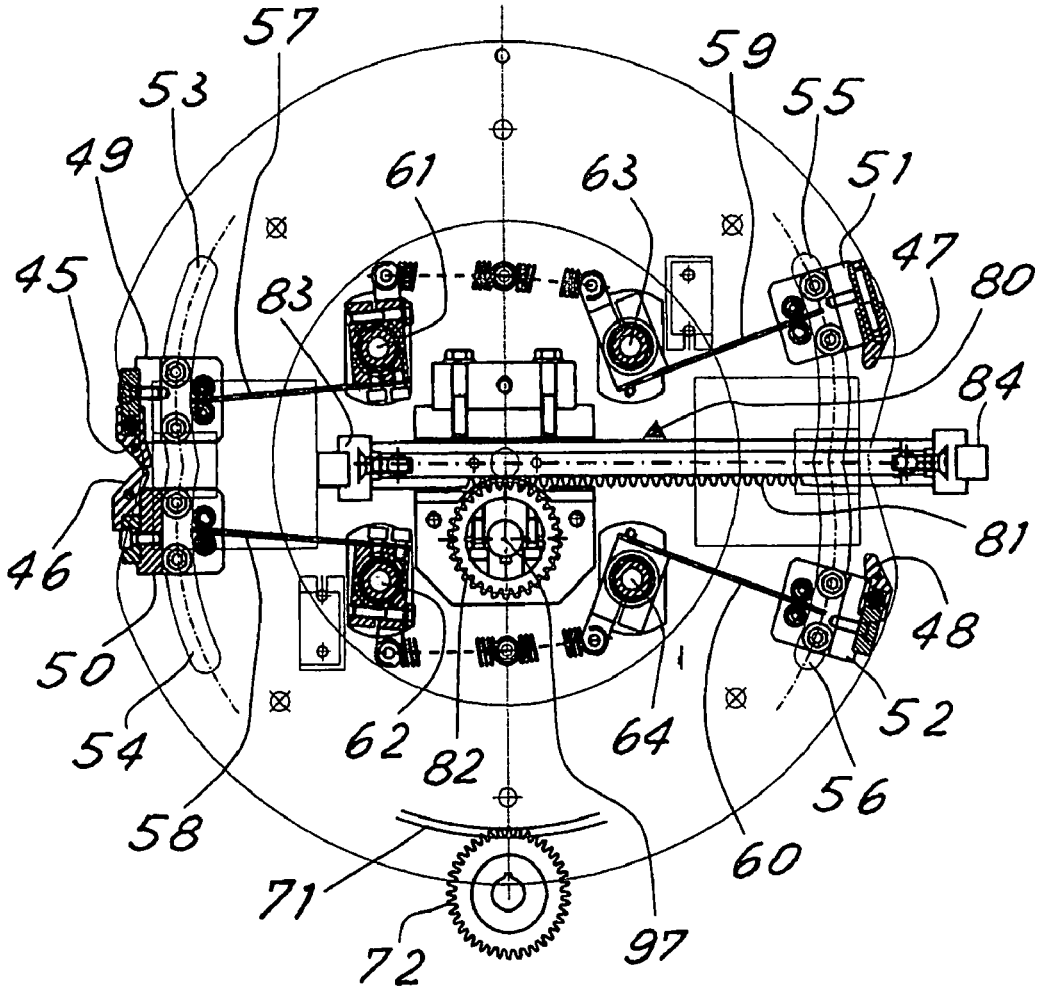
FIG. 3 shows a second schematic side view of another mechanism part arranged on the rotating head of the machine in FIG. 1 for sealing and extracting products.

In FIG. 3 thrusting means is shown in the form of a counterthrust unit 80 that is mounted on the head and has the function of accompanying the product to be wrapped during insertion into the loading station and of simultaneously expelling the product that has already been wrapped that is present in the unloading station. For this purpose, the counterthrust unit 80 comprises a rack 81 that is made to slide by a driven pinion 82 to push two opposite end elements 83, 84 inside and outside the stations in a direction radial to the head by running linearly on the. symmetry axis that passes between the two stations of the head. The driven pinion 82 is coaxial to and integral with the rotating axis 97 of the cam mechanism 41, so that the grasping jaws in the stations of the head open during the steps of introduction and expulsion of the products in phase with the movement of the counterthrust unit.

The two elements 83, 84 are advantageously sprung in a direction that is radial to the head and have a length (parallel to the rotation axis of the head) that is substantially equal to the corresponding dimension of the product.

As will be clear below, the movement drive of the counterthrust unit and the rotation drive of the head can be controlled in such a way as to maintain the correct phase reference thereof despite the synchronous or corresponding movements between the two elements.

FIG. 3 also shows film-sealing means, one for each station of the head, comprising sealing blades supported on the rotating head and arranged in pairs 45, 46 and 47, 48 at the entrance of each rotating station 30, 31. Each blade (suitably heated electrically according to the prior art) is supported by a respective carriage 49, 50, 51, 52 that slides into suitable grooves 53, 54, 55, 56 in the rotating frame of the head, so that the blades of each pair are guided along arc approach and distancing trajectories that touch the product. The function of the blades is to complete winding of the film around the product after it has been inserted into the head and to seal the two edges thereof through the formation of the so-called "fin seal" or longitudinal seal.

Figure 4:
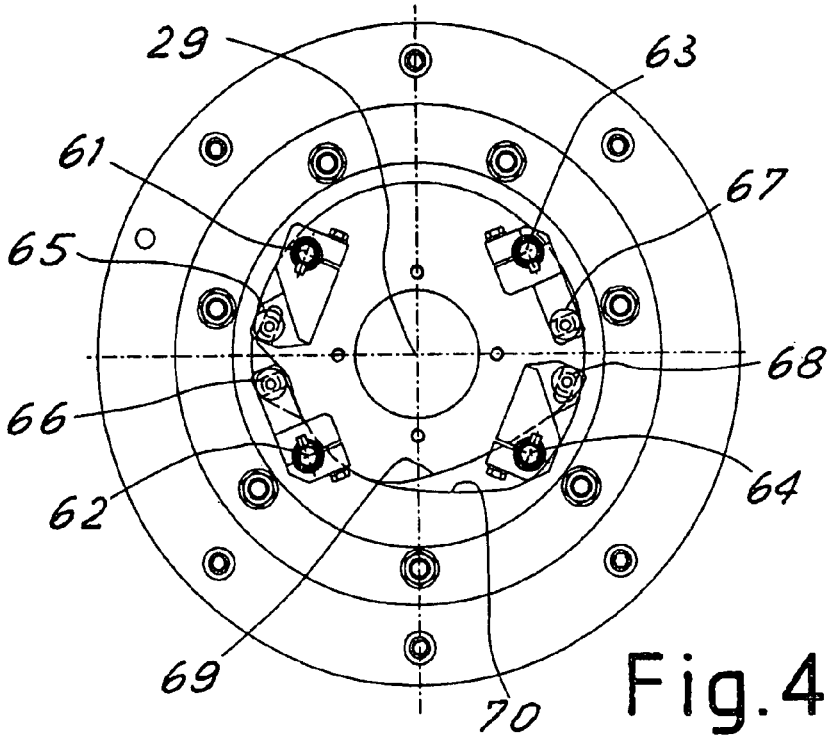
FIG. 4 is a schematic view of cam means for moving sealing blades of the mechanism in FIG. 3; p

For this movement, each support carriage is moved by a respective sliding arm 57, 58, 59, 60 pivoted on the corresponding axis 61, 62, 63, 64. As can be seen in FIG. 4, where another plane along the head axis is shown, each axis 61, 62, 63, 64 is integral with a respective cam follower 65, 66, 67, 68. The cam followers slide on suitable cam surfaces 69, 70 that are rotatable around the main shaft 29 of the head. Antagonist springs ensure adherence of the followers to the cam surfaces.

Figure 5:
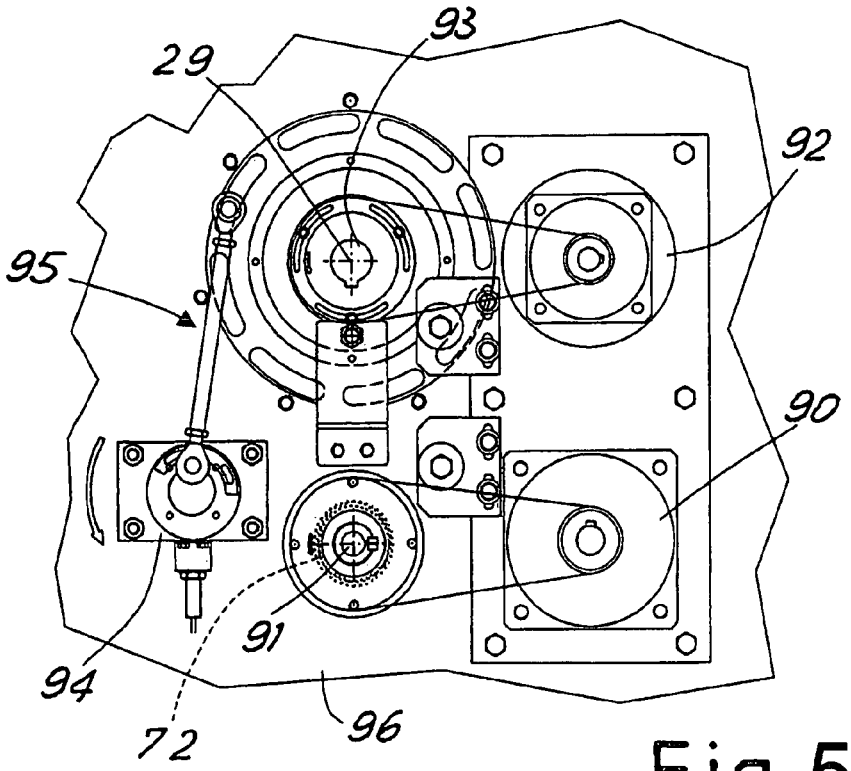
FIG. 5 is a schematic view of drives for driving the rotating head of the machine in FIG. 1.

FIG. 5 shows the drives applied to the head. A first reduction gear 90 drives, through a pulley and belt transmission, a shaft 91 connected to the rotation pinion 71 of the entire head. A second reduction gear 92 drives, through a pulley and belt transmission, a shaft 93, arranged coaxially to the rotation axis of the head and which transmits the movement to the radial movement pinion 82 of the counterthrust unit 80 and to the cams unit 41 of the grasping jaws for grasping the products in the head. Lastly, a reduction gear 94 causes, through a rod and crank transmission 95, oscillation of the cam surfaces 69, 70 around the central axis 29 of the head. Initial closing of the sealers is obtained by making the cams oscillate by means of the reduction gear 94. The size of the oscillation and the speed of the movement can easily be varied in function of the dimension of the products. As will be clear below, the lowering movement of the fin seal and the opening movement of the sealers is obtainable with stationary cams by means of rotation of the head.

The reduction gears and the respective transmissions are supported on a fixed frame 96 that supports the rotating head.

Figure 6:
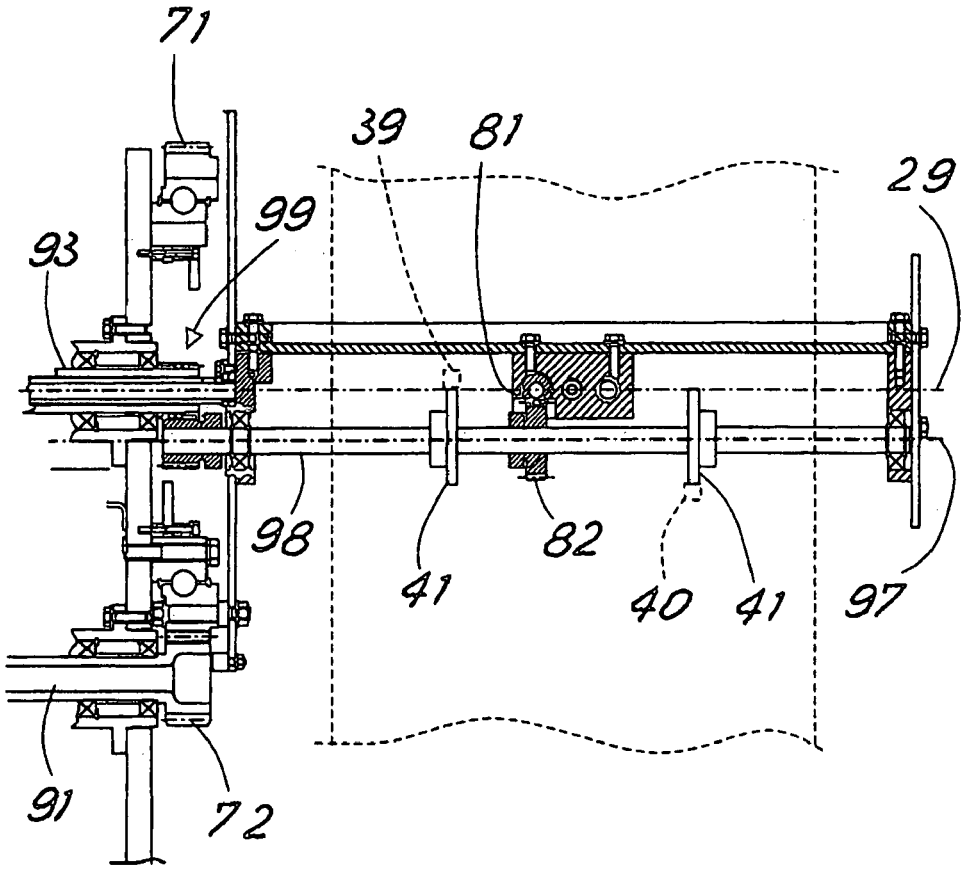
FIG. 6 is a schematic section view, generally taken along line VI-VI of FIG. 2, of part of the rotating drive of the head and of movement of the mechanisms thereof.

FIG. 6 shows schematically the section of the frame 96 on the support side of the shafts 91 and 93. The shaft 91 terminates directly with the pinion 72 that engages the crown gear 71 to the rotating head. The driven shaft 93 is arranged coaxially to the axis 29 of the rotating head, so as not to hinder rotation of the head. The conducted shaft 98, that supports the pinion 82 and the cam mechanism 41 integrally has, however, a staggered axis 97. Coupling between shaft 93 and shaft 98 is obtained by means of a suitable combined gear transmission 99 that enables the shaft 98 to rotate around the axis 29 of the head. The movement gear is the main one and the gear on the shaft of the counterthrust unit is the satellite gear.

Those skilled in the art can easily imagine how it is possible to obtain at will through a suitable command to the drives linear movement of the counterthrust unit with a stationary head, rotation of the head with the counterthrust unit stationary or linear movement of the counterthrust unit during rotation of the head.

With reference to FIGS. 7 to 15 an operating cycle of the sealing head will be disclosed below from receipt of a product to be packaged to dispatch of the product. To make the drawings clearer, only the counterthrust unit and the sealing blades are shown therein. Movement of the receiving jaws 33, 34, 35, 36 (not shown) is nevertheless easily imaginable by those skilled in the art on the basis of the other figures and of the disclosure made above.

Figure 7:
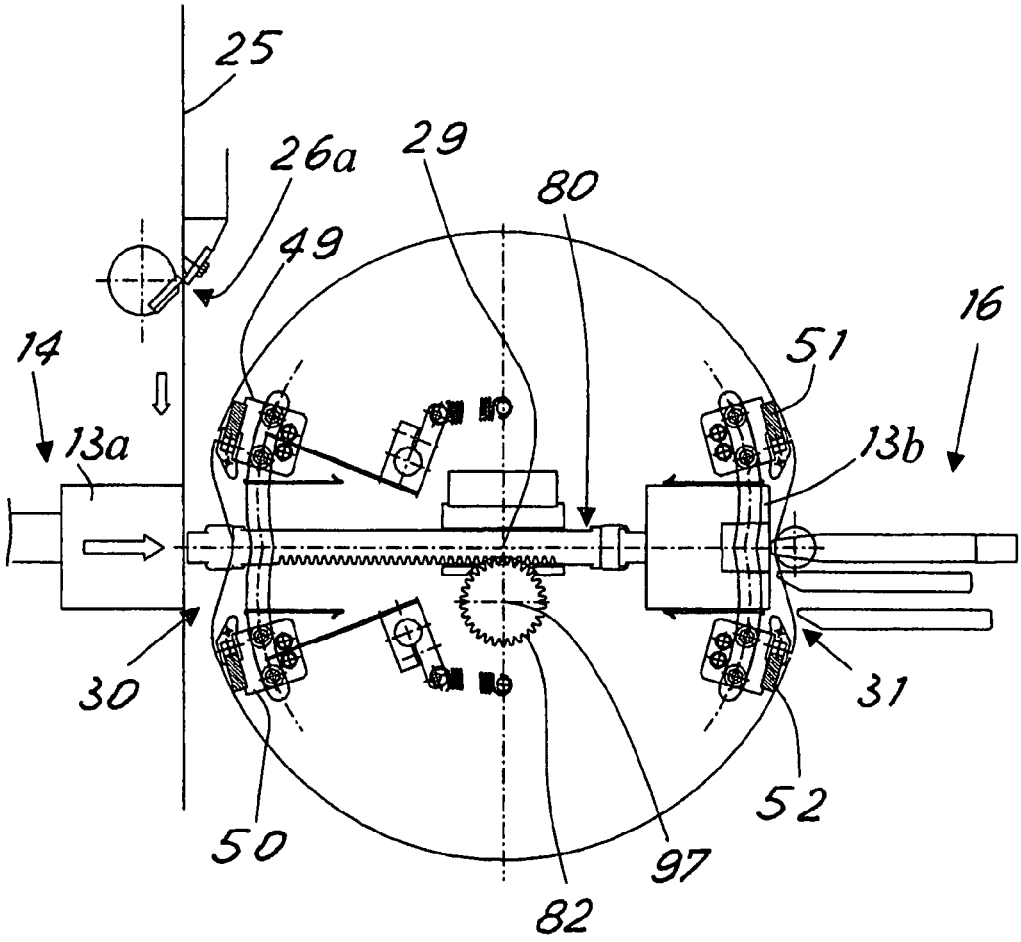

FIG. 7 shows the head with the left station thereof ready to receive a product 13*a* arriving from the inlet bench whilst the right station thereof is ready to dispatch a product 13*b* to the outlet bench. The film 25 hangs with the end edge between the product and head and the knife 26*a* of the feeding and cutting unit 26 is ready to cut the film to the correct length for wrapping.

The product is trapped between the pusher and counterthrust unit. The pusher pushes the product into the station 30 whilst the counterthrust unit, driven by the drive 92, starts the transfer, reaching synchronism with the pusher. During this phase, advantageously crushing (for example of 5 mm) of the yielding end of the counterthrust unit is obtained. The movement of the product drags the wrapping into the station of the head, which wrapping is cut to size by means of the knife 26*a*.

Figure 8:
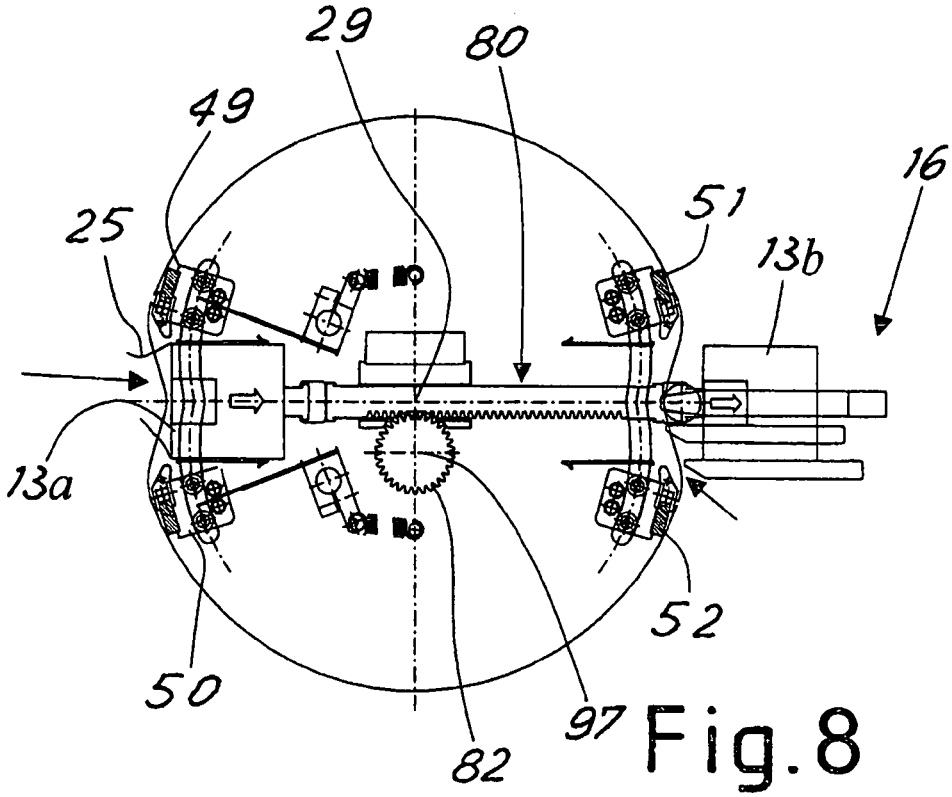

FIG. 8 shows the final phase of insertion of the product, with the pusher and counterthrust unit completing insertion of the product into the head. During the transfer of the counterthrust unit closing of the grippers (not shown) is also implemented as rotation of the movement pinion of the counterthrust unit is integral with that of the cams of the grippers.

The transfer of the counterthrust unit that accompanies loading of the product 13*a* into the station of the head that is opposite the loading station simultaneously ejects the product 13*b* present in the opposite station of the head. The counterthrust unit continues the transfer until complete ejection of the product towards the unloading station 16 has been implemented.

Figure 9:
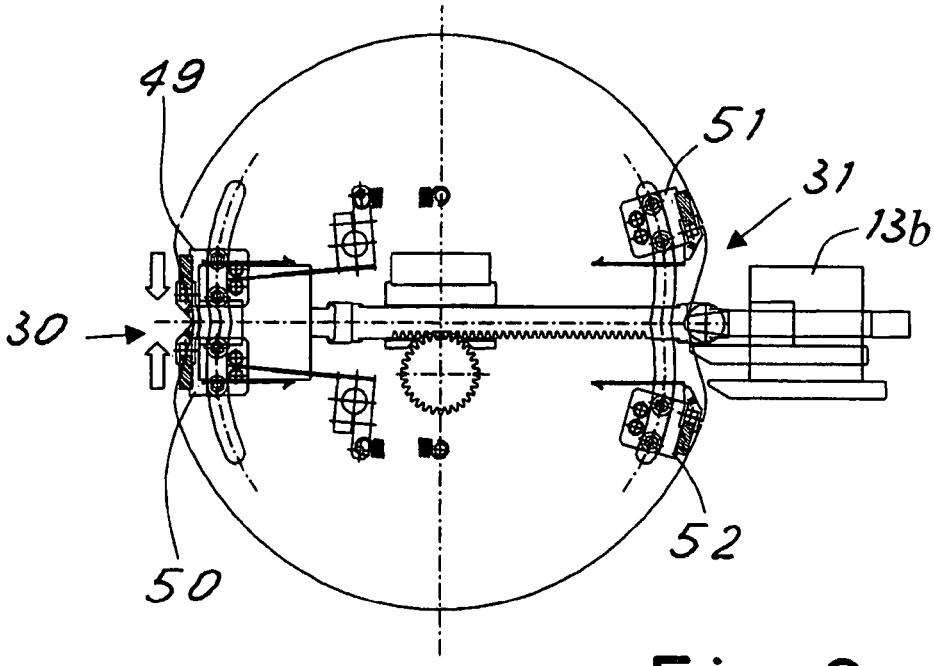

As shown schematically in FIG. 9, after product 13*a* has been completely inserted, the longitudinal sealers are commanded to close, so as to seal the two edges of the film that protrude behind the product. The so-called "fin seal" is thus formed. Closing of the sealing blades is implemented by oscillation of the two cams 69, 70 commanded by the actuator 94.

Figure 10:
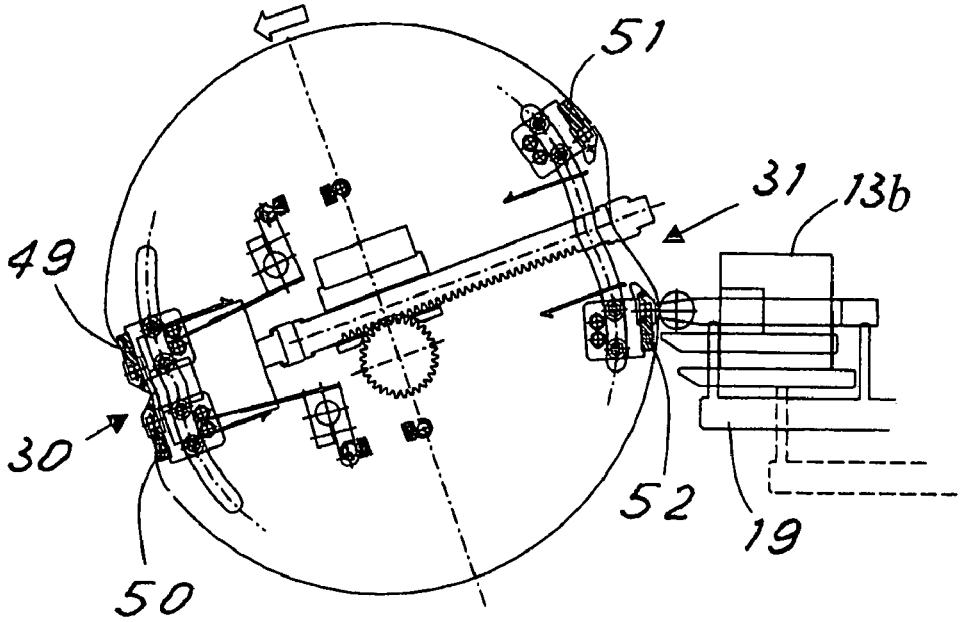
Figure 11:
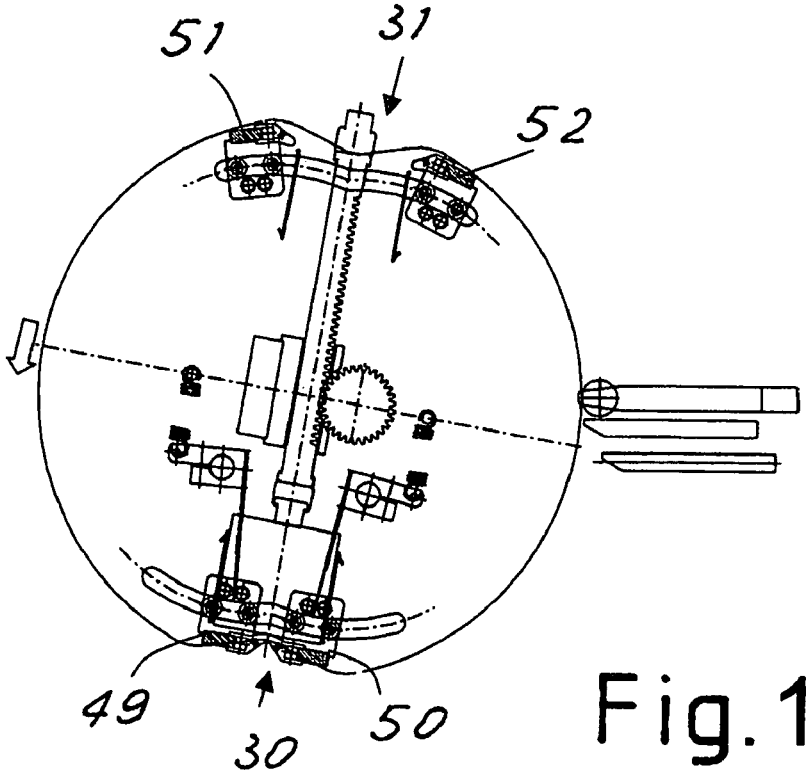

Rotation of the head (by means of the motor 90) is then started. As shown in FIGS. 10 and 11, during rotation of the head the step-moving device 19 captures the product 13*b* that has exited therefrom and starts conveying thereof to the outlet of the machine. During conveying, the outlet bench 17 will thus perform the necessary folding and sealing of the film on both sides of the package.

Figure 12:
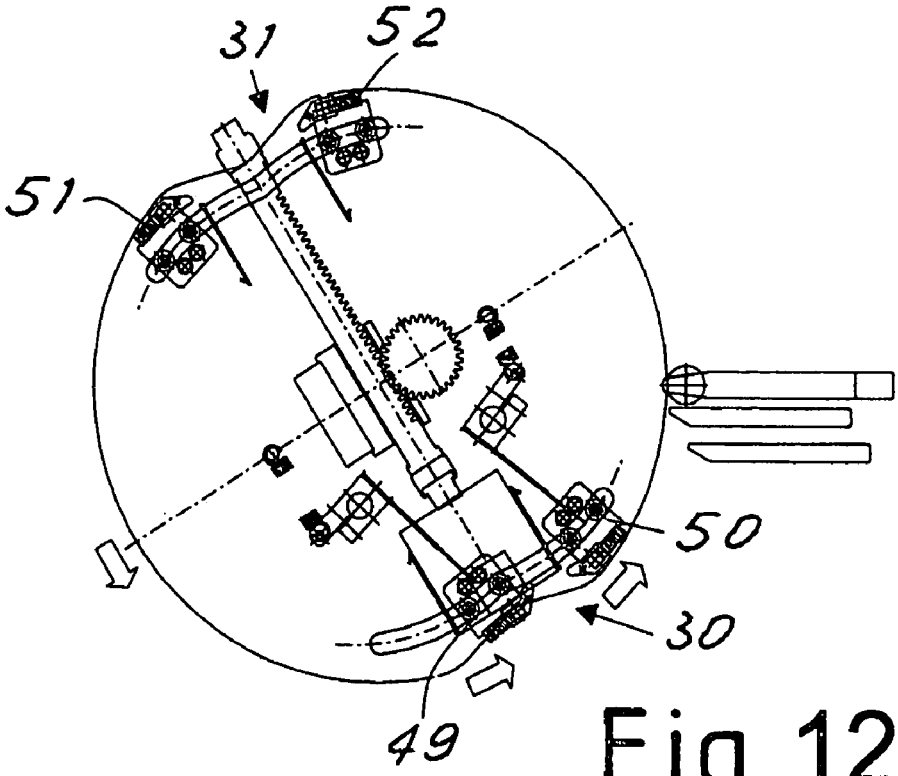
Figure 13:
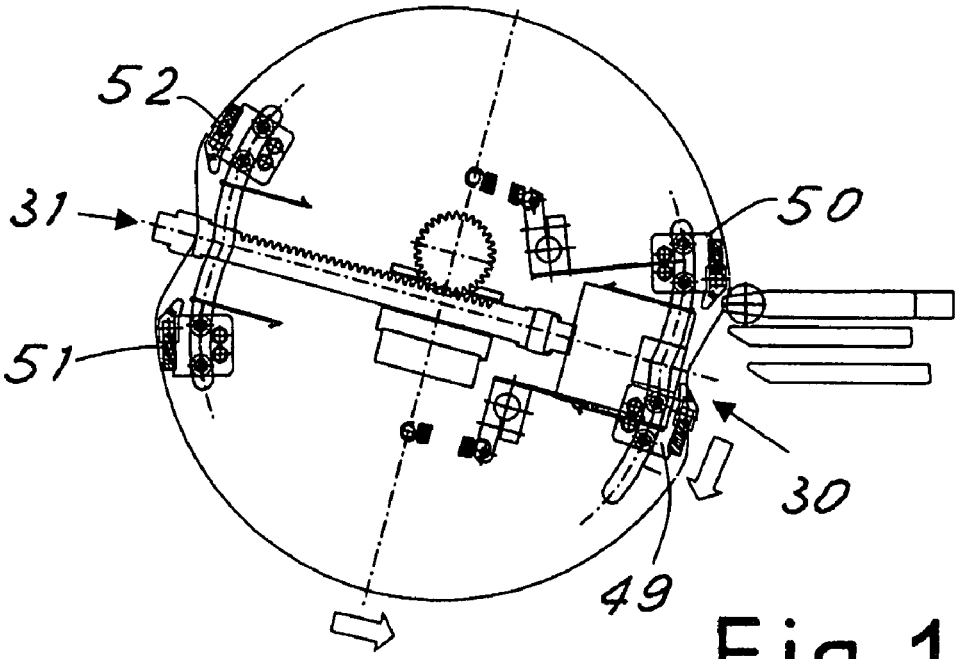

As can be seen from FIGS. 12 and 13, by continuing rotation of the head the position of the sealers is controlled by the corresponding cams 69, 70 (which return to the oscillation start position), formed so as to first perform a concordant movement of the sealing blades in the rotating direction of the head (and consequently an asymmetrical movement of the blades with respect to the respective seat of the product), so as to obtain lowering of the fin seal against the product and flat sealing thereof on the package (FIG. 12), then return to the initial opening position (FIG. 13).

Figure 14:
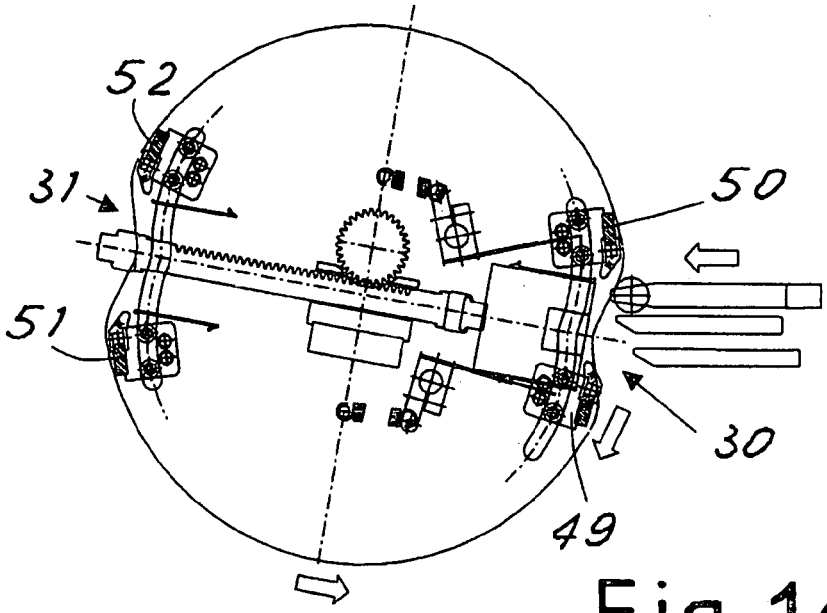

As shown schematically in FIG. 14, during the final head rotation step the product extraction elements of the unloading station 16 again approach the head to prepare for extraction of the product arriving at the station 16.

Figure 15:
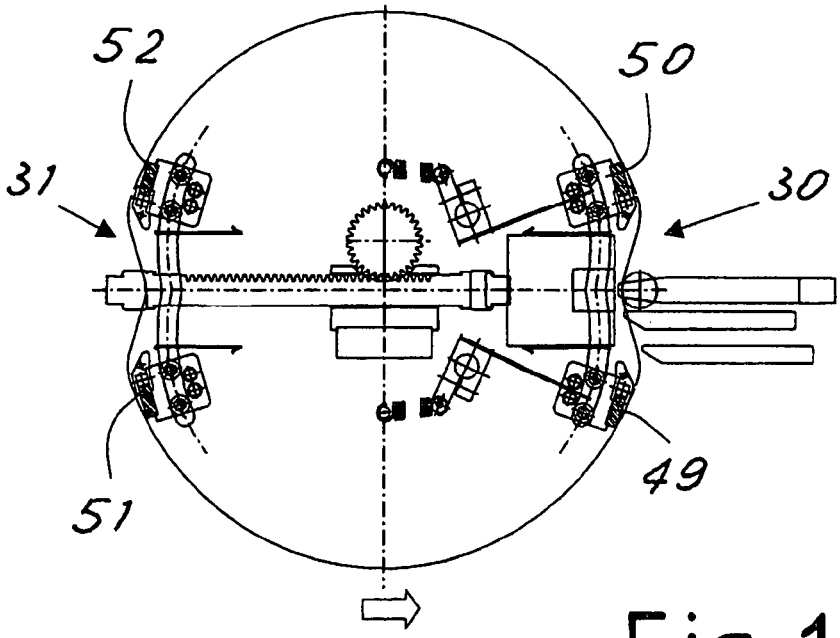

In FIG. 15 rotation of the head terminates and the product 13*a* is released and pushed outside the head by means of the new movement of the counterthrust unit that accompanies loading of a new product into the loading station 14.

The next cycle can thus start with the two diametrically opposite stations of the head, which exchanged places between the product-insertion position and the product-ejection position.

At this point it is clear how the preset objects are achieved, providing a machine equipped with a rotating head with pick-up and sealing means on board that enable sealing operations to be conducted during rotation of the head by 180 degrees between the product loading and unloading stations.

The advantages of a machine made according to the invention are manifold.

By using just two product-pick up stations in the head, one for loading and the other for unloading, the components are reduced that are dedicated to contact with the product and therefore the products that vary with the varying of the size, with significant time and cost gains for the user when he has to carry out the size change.

The folders and sealers of the longitudinal edge are on the head so that the function thereof can intervene during rotation of the head, optimising cycle time and avoiding the need for waits in fixed positions, as on the other hand occurs with known machines.

The counterthrust unit moving the product into and out of the head is integral with the head when the latter rotates and can similarly transfer inside the head regardless of whether the head is moving or is stationary. There is thus an advantage in terms of operating speed and there is for example no need to wait for an element to stop before starting movement of the other one.

Advantageously, during operation the head rotates with a movement that concurs with the advance of the wrapping material and this avoids the typical drawback of traditional machines of interference between the advance of the film being prepared and the edges that have not yet been folded of the packet that is already inside the head.

The reduced number of mechanical parts with respect to traditional machines thus decreases manufacturing costs, maintenance tasks and the likelihood of faults, etc. Furthermore, size-change operations are greatly facilitated, avoiding many mechanical adjustments. The fact of having few devices, which are all in the head and are moved by an independent motor, with the ease of keeping all the motors in step with one another during operation of the machine, enables even complex and substantially independent movements to be obtained easily. For example, owing to the independent drives, sealing time can easily be optimised in any condition and can also be set in function of the maximum operating speed envisaged for each specific size. For example, if the speed envisaged for a product is 80 ppm the temperature parameters of the sealers referring to that speed will be set. If the machine operates at a lower speed for various reasons, the sealing time for maximum speed can be maintained, thus always ensuring good sealing performance.

Naturally, the disclosure made above of an embodiment applying the innovative principles of the present invention is given by way of example of such innovative principles and must not therefore be taken to limit the scope of what is claimed herein.

The invention claimed is:

1. A machine for packaging products in sealed film, comprising a product inlet feeding bench, a rotating head for receiving and conveying products arriving sequentially from the feeding bench to a loading station in the head and an outlet bench that receives the products conveyed by the rotating head to an unloading station to evacuate the products from the machine characterised in that the rotating head comprises peripherally seats for receiving products and sealing means that rotates with the seats for sealing a film wound around the product in a seat while the head rotates to take the seat from the loading station to the unloading station; and wherein the sealing means comprises for each seat a pair of sealing blades supported on the rotating head and movable to close on the entrance of the respective seat and clamp and seal between said sealing blades edges of a strip of film dragged into the seat by the movement introducing the product into the seat, and each sealing blade is supported by a respective carriage that slides in grooves located in a frame of the rotating head, so that the blades of each pair are guided along reciprocal approach and distancing arc trajectories.

2. The machine according to claim 1, characterised in that for dragging the strip into the seat, film feeding means arranges the strip of film between the entrance of the seat at the loading station and a product arriving at the loading station, thrusting means in the loading station pushing the product into the seat together with the strip.

3. The machine according to claim 2, characterised in that the feeding means of the film unrolls the film from a reel and cuts the strip to size whenever a product is introduced into the seat at the loading station.

4. The machine according to claim 1, characterised in that each carriage is moved along the trajectory thereof through rotation of a respective driving arm rotated by a cam mechanism common to all the carriages so as to maintain movement synchronism.

5. The machine according to claim 4, characterised in that the cam mechanism comprises cam followers connected to said arms and which slide on cam surfaces as the head rotates to take the seats from the loading station to the unloading station.

6. The machine according to claim 5, characterised in that further moving means of the cam surfaces permits controlled oscillation of the cam surfaces around the rotation axis of the head to command asymmetrical movement of the blades of each pair so as to lower the sealed edges against the product and flat-seal them on the package.

7. The machine according to claim 1, characterised in that the loading station in the head of the inlet bench and the unloading station from the head of the outlet bench are arranged in a diametrically opposite position on two diametrical sides of the rotating head and said seats on the head are at least two diametrically opposite seats so that when a seat is at the loading station of the inlet bench to be loaded with a product, the other seat is at the unloading station of the outlet bench to be emptied of the product.

8. The machine according to claim 7, characterised in that the head comprises driven thrusting means that is commanded to slide in the direction of inside and outside seats in the head to accompany the entry of the product into the seat at the loading station and simultaneously push the product outside the seat at the unloading station.

9. The machine according to claim 8, characterised in that the thrusting means comprises an element that is slideable in a direction that is diametric to the head and having opposite ends that serve the opposite seats for receiving products.

10. The machine according to claim 9, characterised in that the sliding element is moved radially by means of a driven pinion that is mounted on the head with an axis that is parallel and staggered with respect to the rotation axis of the head, the driven pinion being synchronously controlled with the rotation of the head to keep the sliding element stationary with respect to the head when the head is rotating.

11. The machine according to claim 8, characterised in that each seat comprises receiving means for grasping and retaining on command the product inserted into the seat.

12. The machine according to claim 11, characterised in that the receiving means comprises jaws for grasping the product that through the movement thereof are kinetically connected to the drive of the driven thrusting means to move synchronously therewith by means of the same drive.

13. The machine according to claim 1, characterised in that the inlet bench comprises a slat conveying system for the products that terminates in the loading station.

14. The machine according to claim 1, characterised in that the outlet bench comprises a sliding device for the products from the unloading station to the outlet, along which are located folding means for folding parts of film on the sides of the products for completing the closure of the packaging.

15. The machine according to claim 14, characterised in that the sliding device is a step sliding device.

16. The machine according to claim 1, characterised in that the head comprises for each seat controlled means for grasping and retaining a product inserted into the seat and controlled thrusting means for pushing the product outside the seat, wherein the grasping means, the thrusting means and the sealing means being moved synchronously with each other to run sequentially, during rotation of the head from the loading station to the unloading station, to perform the operations of grasping a product inserted into a seat in the loading station, sealing of edges of film that wind around the product, lowering the sealed edges against the product, and the ejection of the product to the unloading station.

* * * * *